US011015409B2

(12) United States Patent
Xu et al.

(10) Patent No.: US 11,015,409 B2
(45) Date of Patent: May 25, 2021

(54) SYSTEM FOR DEGRADING STRUCTURE USING MECHANICAL IMPACT AND METHOD

(71) Applicants: YingQing Xu, Tomball, TX (US); Zhihui Zhang, Katy, TX (US); James Doane, Friendswood, TX (US); Zhiyue Xu, Cypress, TX (US)

(72) Inventors: YingQing Xu, Tomball, TX (US); Zhihui Zhang, Katy, TX (US); James Doane, Friendswood, TX (US); Zhiyue Xu, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 204 days.

(21) Appl. No.: 15/699,216

(22) Filed: Sep. 8, 2017

(65) Prior Publication Data

US 2019/0078410 A1 Mar. 14, 2019

(51) Int. Cl.

| | |
|---|---|
| ***E21B 29/02*** | (2006.01) |
| ***E21B 23/04*** | (2006.01) |
| ***E21B 43/1185*** | (2006.01) |
| *C06B 33/08* | (2006.01) |
| *C06B 33/06* | (2006.01) |

(52) U.S. Cl.

CPC ..... *E21B 29/02* (2013.01); *E21B 23/04* (2013.01); *E21B 43/1185* (2013.01); *C06B 33/06* (2013.01); *C06B 33/08* (2013.01)

(58) Field of Classification Search

CPC ..... C06B 33/06; C06B 33/08; E21B 23/04; E21B 29/02; E21B 43/1185

USPC ..... 431/255

See application file for complete search history.

(56) References Cited

U.S. PATENT DOCUMENTS

| | | | | |
|---|---|---|---|---|
| 2,637,402 A | | 5/1953 | Baker et al. | |
| 2,695,064 A | | 11/1954 | Ragan et al. | |
| 2,857,847 A | * | 10/1958 | Seavey | F42B 1/04 102/204 |
| 3,497,002 A | | 2/1970 | Berryman | |
| 3,687,196 A | | 8/1972 | Mullins | |
| 4,527,481 A | * | 7/1985 | Evans | F42C 19/10 102/204 |

(Continued)

FOREIGN PATENT DOCUMENTS

| | | | | |
|---|---|---|---|---|
| EP | 0122012 A2 | | 10/1984 | |
| GB | 143268 A | * | 9/1921 | F42B 12/68 |
| WO | 2013022635 A2 | | 2/2013 | |

OTHER PUBLICATIONS

Notification of Transmittal of the International Search Report and the Written Opinion of the International Searching Authority; PCT/US2018/047315; dated Dec. 21, 2018; 12 pages.

(Continued)

*Primary Examiner* — Steven B McAllister
*Assistant Examiner* — Benjamin W Johnson
(74) *Attorney, Agent, or Firm* — Cantor Colburn LLP

(57) ABSTRACT

A system for degrading a structure includes the structure formed of a degradable-on-demand material, an ignitor arranged to transfer heat to the structure; and, a mechanical impactor movable with respect to the structure, wherein the ignitor increases in temperature upon impact of the mechanical impactor into the ignitor, and heat from the ignitor initiates degradation of the structure.

20 Claims, 5 Drawing Sheets

(56) References Cited

U.S. PATENT DOCUMENTS

| | | | | |
|---|---|---|---|---|
| 5,052,489 | A | 10/1991 | Carisella et al. | |
| 5,386,780 | A | 2/1995 | Klein | |
| 5,680,905 | A | 10/1997 | Green et al. | |
| 5,709,269 | A | 1/1998 | Head | |
| 5,911,277 | A | 6/1999 | Hromas et al. | |
| 6,253,843 | B1 | 7/2001 | Rawson et al. | |
| 7,270,191 | B2 | 9/2007 | Drummond et al. | |
| 7,475,736 | B2 | 1/2009 | Slup et al. | |
| 7,726,406 | B2 | 6/2010 | Xu | |
| 8,056,638 | B2 | 11/2011 | Clayton et al. | |
| 8,235,102 | B1 | 8/2012 | Robertson | |
| 8,256,521 | B2 | 9/2012 | Swor et al. | |
| 8,272,446 | B2 | 9/2012 | Swor et al. | |
| 8,291,969 | B2 | 10/2012 | Swor et al. | |
| 8,291,970 | B2 | 10/2012 | Swor et al. | |
| 8,322,449 | B2 | 12/2012 | Clayton et al. | |
| 8,327,926 | B2 | 12/2012 | Robertson | |
| 8,403,037 | B2 | 3/2013 | Agrawal et al. | |
| 8,485,265 | B2 | 7/2013 | Marya et al. | |
| 8,528,633 | B2 | 9/2013 | Agrawal et al. | |
| 9,022,107 | B2 | 5/2015 | Agrawal et al. | |
| 9,101,978 | B2 | 8/2015 | Xu et al. | |
| 9,163,467 | B2 | 10/2015 | Gaudette et al. | |
| 9,228,404 | B1 | 1/2016 | Jackson et al. | |
| 9,267,347 | B2 | 2/2016 | Agrawal et al. | |
| 9,334,719 | B2 | 5/2016 | Rytlewski et al. | |
| 9,528,342 | B2 | 12/2016 | Xu et al. | |
| 9,656,926 | B1 | 5/2017 | Thoma et al. | |
| 9,689,247 | B2 | 6/2017 | Holder et al. | |
| 9,816,339 | B2 | 11/2017 | Xu | |
| 10,087,714 | B2 | 10/2018 | Harper et al. | |
| 10,167,691 | B2 | 1/2019 | Zhang et al. | |
| 2004/0216887 | A1 | 11/2004 | Bertelsen | |
| 2007/0209802 | A1 | 9/2007 | Xu et al. | |
| 2008/0251261 | A1 | 10/2008 | Arce et al. | |
| 2010/0101803 | A1* | 4/2010 | Clayton | E21B 29/02 166/376 |
| 2011/0000663 | A1* | 1/2011 | Brandsdal | E21B 33/12 166/178 |
| 2013/0062055 | A1 | 3/2013 | Tolman et al. | |
| 2013/0081825 | A1 | 4/2013 | Lynde et al. | |
| 2013/0118805 | A1 | 5/2013 | Moody-Stuart et al. | |
| 2013/0160992 | A1 | 6/2013 | Agrawal et al. | |
| 2014/0014339 | A1 | 1/2014 | O'Malley et al. | |
| 2014/0190685 | A1 | 7/2014 | Frazier et al. | |
| 2014/0202712 | A1 | 7/2014 | Fripp et al. | |
| 2014/0251612 | A1 | 9/2014 | Powers | |
| 2014/0262327 | A1 | 9/2014 | Xu et al. | |
| 2014/0345878 | A1 | 11/2014 | Murphree et al. | |
| 2014/0363692 | A1 | 12/2014 | Marya et al. | |
| 2015/0021023 | A1 | 1/2015 | Roberts et al. | |
| 2015/0027723 | A1 | 1/2015 | Fripp et al. | |
| 2015/0159468 | A1 | 6/2015 | Mailand | |
| 2015/0190984 | A1 | 7/2015 | Zhang et al. | |
| 2015/0239795 | A1 | 8/2015 | Doud et al. | |
| 2015/0259263 | A1 | 9/2015 | Sherman et al. | |
| 2015/0292288 | A1 | 10/2015 | Kasperski et al. | |
| 2016/0130906 | A1 | 5/2016 | Garvey et al. | |
| 2016/0186044 | A1 | 6/2016 | Rothrock et al. | |
| 2016/0209391 | A1 | 7/2016 | Zhang et al. | |
| 2016/0290093 | A1 | 10/2016 | Doane et al. | |
| 2016/0333668 | A1 | 11/2016 | Xu et al. | |
| 2017/0009563 | A1 | 1/2017 | Holder | |
| 2017/0138169 | A1 | 5/2017 | Bogdan et al. | |
| 2017/0218722 | A1 | 8/2017 | Gordon et al. | |
| 2018/0171736 | A1 | 6/2018 | Xu et al. | |
| 2018/0171737 | A1 | 6/2018 | Xu et al. | |
| 2018/0171738 | A1 | 6/2018 | Xu et al. | |
| 2018/0171757 | A1 | 6/2018 | Xu | |
| 2018/0230769 | A1 | 8/2018 | Xu et al. | |
| 2018/0230770 | A1 | 8/2018 | Oag et al. | |
| 2018/0245448 | A1 | 8/2018 | Fripp et al. | |
| 2018/0252070 | A1 | 9/2018 | Zhu et al. | |
| 2018/0283119 | A1 | 10/2018 | Zhang et al. | |
| 2018/0283121 | A1 | 10/2018 | Zhang et al. | |
| 2018/0283141 | A1 | 10/2018 | Zhang et al. | |
| 2018/0283142 | A1 | 10/2018 | Zhang et al. | |
| 2018/0334873 | A1 | 11/2018 | Marya | |
| 2019/0032435 | A1* | 1/2019 | Kochanek | E21B 29/02 |
| 2019/0249510 | A1 | 8/2019 | Deng et al. | |

OTHER PUBLICATIONS

"Spectre Disintegrating Frac Plug", Baker Hughes, 2015, 8 Pages.

Huang et al. "Construction and Properties of Structure- and Size-controlled Micro/nano-Energetic Materials", Defence Technology 9 (2013) 59-79.

International Search Report and Written Opinion for International Application No. PCT/US2017/062263; International Filing Date Nov. 17, 2017; Report dated Feb. 22, 2018 (pp. 1-18).

International Search Report and Written Opinion for International Application No. PCT/US2017/062264; International Filing Date Nov. 17, 2017; Report dated Mar. 9, 2018 (pp. 1-18).

International Search Report and Written Opinion for International Application No. PCT/US2017/062275; International Filing Date Nov. 17, 2017; Report dated Mar. 12, 2018 (pp. 1-16).

International Search Report and Written Opinion for International Application No. PCT/US2017/062278; International Filing Date Nov. 17, 2017; Report dated Mar. 8, 2018 (pp. 1-18).

International Search Report and Written Opinion for International Application No. PCT/US2017/062286; International Filing Date Nov. 17, 2017; Report dated Mar. 13, 2018 (pp. 1-18).

International Search Report and Written Opinion for International Application No. PCT/US2017/062291; International Filing Date Nov. 17, 2017; Report dated Feb. 20, 2018 (pp. 1-18).

International Search Report and Written Opinion for International Application No. PCT/US2017/062292; International Filing Date Nov. 17, 2017; Report dated Mar. 16, 2018 (pp. 1-16).

International Search Report and Written Opinion for International Application No. PCT/US2017/062285, International Filing Date Nov. 17, 2017; Report dated Mar. 5, 2018 (pp. 1-18).

* cited by examiner

SYSTEM FOR DEGRADING STRUCTURE USING MECHANICAL IMPACT AND METHOD

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations. Recently, self-disintegrating or interventionless downhole tools have been developed. Instead of milling or drilling operations, these tools can be removed by dissolution of engineering materials using various wellbore fluids.

BRIEF DESCRIPTION

A system for degrading a structure, the system including the structure formed of a degradable-on-demand material, an ignitor arranged to transfer heat to the structure, and a mechanical impactor movable with respect to the structure, wherein the ignitor increases in temperature upon impact of the mechanical impactor into the ignitor, and heat from the ignitor initiates degradation of the structure.

A method of degrading a structure, the method including moving a mechanical impactor with respect to the structure, impacting the impactor into an ignitor to increase a temperature of the ignitor, transferring heat from the ignitor to the structure to initiate degradation of a degradable-on-demand material of the structure, and degrading the degradable-on-demand material of the structure.

BRIEF DESCRIPTION OF THE DRAWINGS

The following descriptions should not be considered limiting in any way. With reference to the accompanying drawings, like elements are numbered alike.

DETAILED DESCRIPTION

Figure 1A:
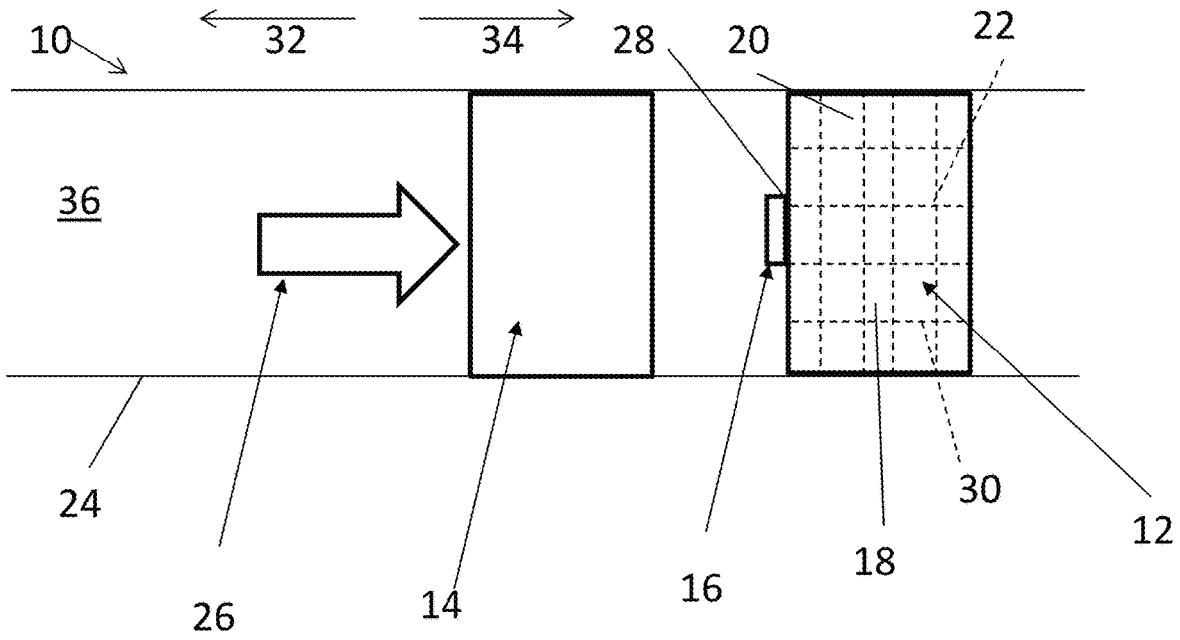
FIG. 1A is a schematic diagram of an embodiment of a system for degrading a downhole structure prior to the downhole structure being degraded and FIG. 1B is a schematic diagram of the system after the downhole structure has begun to degrade.

With reference now to FIG. 1A, one embodiment of a system 10 for degrading a degradable-on-demand ("DOD") structure 12 includes an impactor 14 and an ignitor 16, and the structure 12 itself. The structure 12 has either a minimized disintegration rate or no disintegration at all while the structure 12 is in service but can rapidly degrade, including partial or complete disintegration, when selectively initiated to degrade. As will be further described below, the structure 12 includes a DOD material 18 that may include a matrix material 20 and an energetic material 22 configured to generate energy upon activation to facilitate the degradation of the structure 12. The structure 12 may be only a portion of a downhole tool or may be an entire downhole tool. The system 10 is usable downhole within a downhole tubular 24. The downhole tubular 24 may be, but is not limited to, a borehole casing or an open borehole, an outer tubular, an inner tubular, a fluid conduit, and a portion of a downhole tool. The impactor 14 is movable within the downhole tubular 24 towards the ignitor 16. To move the impactor 14, a driving source 26 is utilized that may include, but is not limited to, hydraulic pressure, direct mechanical movement, or other energy release.

Figure 1B:
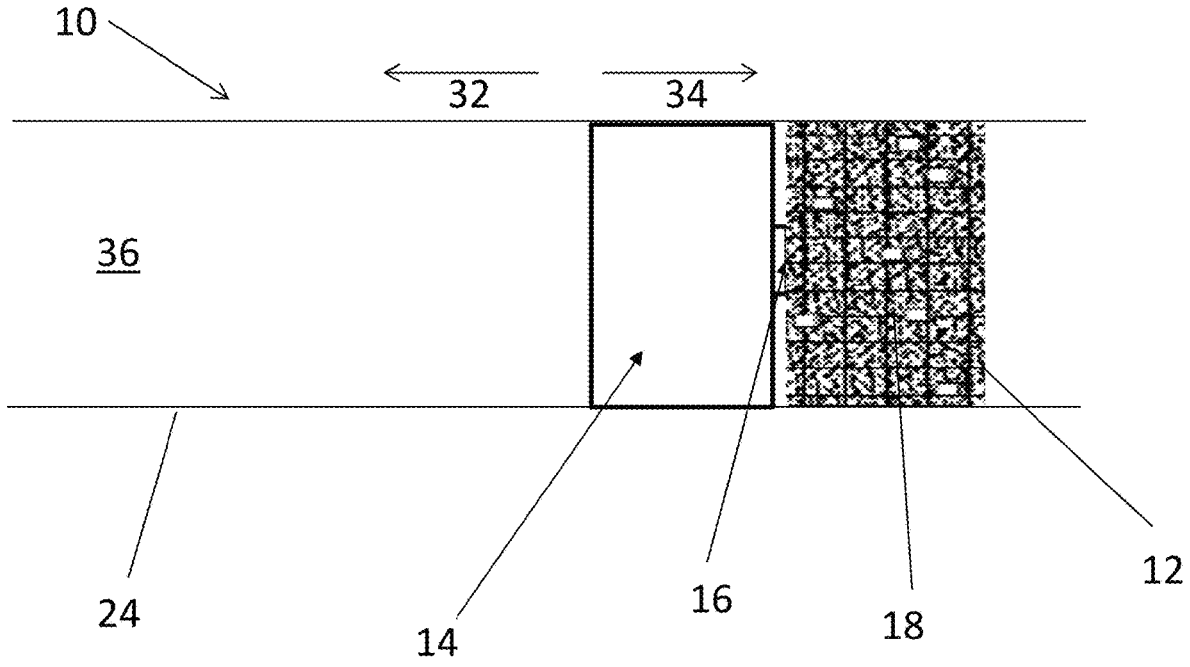

With reference to FIG. 1B, once the ignitor 16 is impacted, punched, or otherwise contacted by the impactor 14 with a force that meets or exceeds an impact threshold, the ignitor 16 is ignited. In one embodiment, the ignitor 16 may include a percussive initiator to set off a firing when contacted by the impactor 14. A percussive initiator is typically employed in a tubing conveyed perforator to initiate the detonation chain of a perforation gun to perforate a casing. However, in the system 10 disclosed herein, the ignitor 16 may include just enough of an explosive material to create a spark, in order to initiate the ignition and degradation of the structure 12, as opposed to perforating the downhole tubular 24. While the ignitor 16 is schematically depicted in FIGS. 1A and 1B, the ignitor 16 may include any feature(s) that transfer heat from the ignitor 16 to the structure 12, either directly or indirectly. In another embodiment, as will be further described with respect to FIG. 5 below, the impact to the ignitor 16 may cause the interaction of two or more chemicals, the interaction of which will generate heat. Heat may be immediately or substantially immediately released upon impact of the ignitor 16 to begin the degradation of the structure 12, or in other embodiments, the impact may create a more gradual increase in temperature, such that eventually the ignitor 16 reaches a threshold temperature and enough heat is transferred to the structure 12 to begin the degradation of the structure 12. The threshold temperature required to begin degradation of the structure 12 will at least be greater than a temperature that naturally occurs in the downhole environment where the structure 12 is intended to be employed. Thus, only when the structure 12 is exposed to the threshold temperature from the ignitor 16 will the structure 12 begin to degrade.

Once the ignitor 16 releases heat at or above the threshold temperature, and the structure 12 is exposed to the threshold temperature or above to begin the degradation of the structure 12, the structure 12 will begin to degrade, as schematically depicted in FIG. 1B. The structure 12 is made of DOD material 18 including energetic material 22 having structural properties and DOD properties as indicated herein and may include material commercially available from Baker Hughes Incorporated, Houston, Texas. Such material is further described below.

The energetic material 22 can be in the form of continuous fibers, wires, foils, particles, pellets, short fibers, or a combination comprising at least one of the foregoing. In the structure 12, the energetic material 22 is interconnected in such a way that once a reaction of the energetic material 22 is initiated at one or more starting locations or points 28, the reaction can self-propagate through the energetic material 22 in the structure 12. As used herein, interconnected or interconnection is not limited to physical interconnection. The energetic material 22 may include a thermite, a reactive multi-layer foil, an energetic polymer, or a combination comprising at least one of the foregoing. Use of energetic materials 22 disclosed herein is advantageous as these energetic materials 22 are stable at wellbore temperatures but produce an extremely intense exothermic reaction following activation, which facilitates the rapid disintegration of the structure 12.

The energetic material 22 may include a thermite, a thermate, a solid propellant fuel, or a combination comprising at least one of the foregoing. The thermite materials include a metal powder (a reducing agent) and a metal oxide (an oxidizing agent), where choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide and combinations including at least one of the foregoing, for example.

Thermate materials comprise a metal powder and a salt oxidizer including nitrate, chromate and perchlorate. For example thermate materials include a combination of barium chromate and zirconium powder; a combination of potassium perchlorate and metal iron powder; a combination of titanium hydride and potassium perchlorate, a combination of zirconium hydride and potassium perchlorate, a combination of boron, titanium powder, and barium chromate, or a combination of barium chromate, potassium perchlorate, and tungsten powder.

Solid propellant fuels may be generated from the thermate compositions by adding a binder that meanwhile serves as a secondary fuel. The thermate compositions for solid propellants include, but are not limited to, perchlorate and nitrate, such as ammonium perchlorate, ammonium nitrate, and potassium nitrate. The binder material is added to form a thickened liquid and then cast into various shapes. The binder materials include polybutadiene acrylonitrile (PBAN), hydroxyl-terminated polybutadiene (HTPB), or polyurethane. An exemplary solid propellant fuel includes ammonium perchlorate ($NH_4ClO_4$) grains (20 to 200 μm) embedded in a rubber matrix that contains 69-70% finely ground ammonium perchlorate (an oxidizer), combined with 16-20% fine aluminum powder (a fuel), held together in a base of 11-14% polybutadiene acrylonitrile or hydroxyl-terminated polybutadiene (polybutadiene rubber matrix). Another example of the solid propellant fuels includes zinc metal and sulfur powder.

The energetic material 22 may also include energetic polymers possessing reactive groups, which are capable of absorbing and dissipating energy. During the activation of energetic polymers, energy absorbed by the energetic polymers causes the reactive groups on the energetic polymers, such as azido and nitro groups, to decompose releasing gas along with the dissipation of absorbed energy and/or the dissipation of the energy generated by the decomposition of the active groups. The heat and gas released promote the degradation of the structure 12.

Energetic polymers include polymers with azide, nitro, nitrate, nitroso, nitramine, oxetane, triazole, and tetrazole containing groups. Polymers or co-polymers containing other energetic nitrogen containing groups can also be used. Optionally, the energetic polymers further include fluoro groups such as fluoroalkyl groups.

Exemplary energetic polymers include nitrocellulose, azidocellulose, polysulfide, polyurethane, a fluoropolymer combined with nano particles of combusting metal fuels, polybutadiene; polyglycidyl nitrate such as polyGLYN, butanetriol trinitrate, glycidyl azide polymer (GAP), for example, linear or branched GAP, GAP diol, or GAP triol, poly[3-nitratomethyl-3-methyl oxetane](polyNIMMO), poly(3,3-bis-(azidomethyl)oxetane (polyBAMO) and poly (3-azidomethyl-3-methyl oxetane) (polyAMMO), polyvinylnitrate, polynitrophenylene, nitramine polyethers, or a combination comprising at least one of the foregoing.

The energetic material 22 of the structure 12 may be provided within a matrix material 20, with the energetic material 22 dispersed or positioned within the matrix material 20, such that the DOD material 18 includes both the energetic material 22 and the matrix material 20. The matrix material 20 is distributed throughout the three dimensional network 30. The energetic material 22 may form an interconnected network 30. The structure 12 can be formed by forming a porous preform from the energetic material 22, and filling or infiltrating the matrix material 20 into the preform under pressure at an elevated temperature. In another embodiment, the energetic material 22 is randomly distributed in the matrix material 20 in the form of particles, pellets, short fibers, or a combination comprising at least one of the foregoing. The structure 12 can be formed by mixing and compressing the energetic material 22 and the matrix material 20. In yet another embodiment, the structure 12 includes an inner portion and an outer portion disposed on the inner portion, where the inner portion includes a core material that is corrodible in a downhole fluid; and the outer portion includes the matrix material 20 and the energetic material 22. Core materials may include corrodible materials that have a higher corrosion rate in downhole fluids than the matrix material 20 of the outer portion when tested under the same conditions. Once the energetic material 22 in the outer portion of the structure 12 is activated, the outer portion disintegrates exposing the inner portion of the structure 12. Since the inner portion of the structure 12 has an aggressive corrosion rate in a downhole fluid, the inner portion of the structure 12 can rapidly disintegrate once exposed to a downhole fluid.

The matrix material 20 may include a polymer, a metal, a composite, or a combination comprising at least one of the foregoing, which provides the general material properties such as strength, ductility, hardness, density for tool functions. As used herein, a metal includes metal alloys. The matrix material 20 can be corrodible or substantially non-corrodible in a downhole fluid, although if corrodible the corrosion rate within downhole fluid may be slow enough in order for the structure 12 to perform its intended function prior to degradation. The downhole fluid comprises water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing. The heat generated by the energetic material 22 when activated by the ignitor 16 accelerates the corrosion of the matrix material 20.

In an embodiment, the corrodible matrix material 20 comprises Zn, Mg, Al, Mn, an alloy thereof, or a combination comprising at least one of the foregoing. The corrodible matrix material 20 can further comprise Ni, W, Mo, Cu, Fe, Cr, Co, an alloy thereof, or a combination comprising at least one of the foregoing.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloy particles including those prepared from magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

In an embodiment, the matrix formed from the matrix material 20 has a substantially-continuous, cellular nanomatrix comprising a nanomatrix material 20; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles. The matrix comprises deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material 20 comprises Al, Zn, Mn, Mg, Mo, W, Cu, Fe, Si, Ca, Co, Ta, Re or Ni, or an oxide, carbide or nitride thereof, or a combination of any of the aforementioned materials.

The matrix can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W. Cu, Fe, Si, Ca, Co, Ta, Re, or No. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the structure 12.

The matrix material 20 can be degradable polymers and their composites including poly(lactic acid) (PLA), poly (glycolic acid) (PGA), polycaprolactone (PCL), polylactide-co-glycolide, polyurethane such as polyurethane having ester or ether linkages, polyvinyl acetate, polyesters, and the like.

Optionally, the matrix material 20 further comprises additives such as carbides, nitrides, oxides, precipitates, dispersoids, glasses, carbons, or the like in order to control the mechanical strength and density of the structure 12.

The amount of the energetic material 22 is not particularly limited and is generally in an amount sufficient to generate enough energy to facilitate the rapid disintegration of the structure 12 once the energetic material 22 is activated by the ignitor 16. In one embodiment, the energetic material 22 is present in an amount of about 0.5 wt. % to about 45 wt. % or about 0.5 wt. % to about 20 wt. % based on the total weight of the structure 12.

After impact of the mechanical impactor 14 on the ignitor 16, the mechanical impactor 14 can remain intact, and can be either removed in an uphole direction 32 for removal from the downhole tubular 24, or, after the structure 12 has degraded, the mechanical impactor 14 can be moved further in a downhole direction 34 to impact a second ignitor 16 associated with a second structure 12 for the subsequent removal of the second structure 12.

Figure 2:
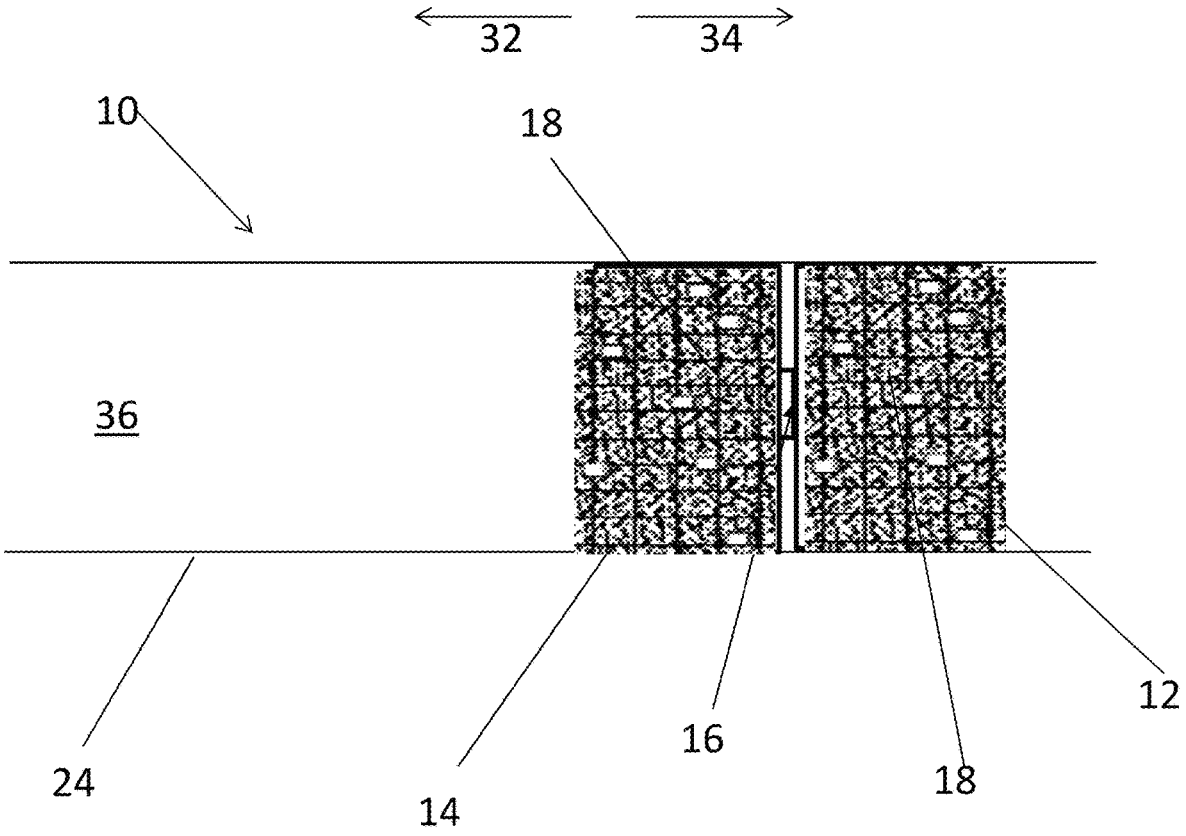
FIG. 2 is another embodiment of a system for degrading a downhole structure where a mechanical impactor of the system has also begun to degrade.

In another embodiment, as shown in FIG. 2, the impactor 14 may also be made of DOD material 18 such that upon impact of the impactor 14 on the ignitor 16, the heat from the ignitor 16 will additionally begin the degradation of the impactor 14. When both the DOD structure 12 and the impactor 14 are substantially or completely disintegrated, a clear or substantially clear path is provided through the downhole tubular 24 after impact and degradation without having to pull the impactor 14 from the downhole tubular 24. The borehole will then be usable for other operations, such as, but not limited to, passage of fluids and/or downhole tools through the flowbore 36.

Figure 3:
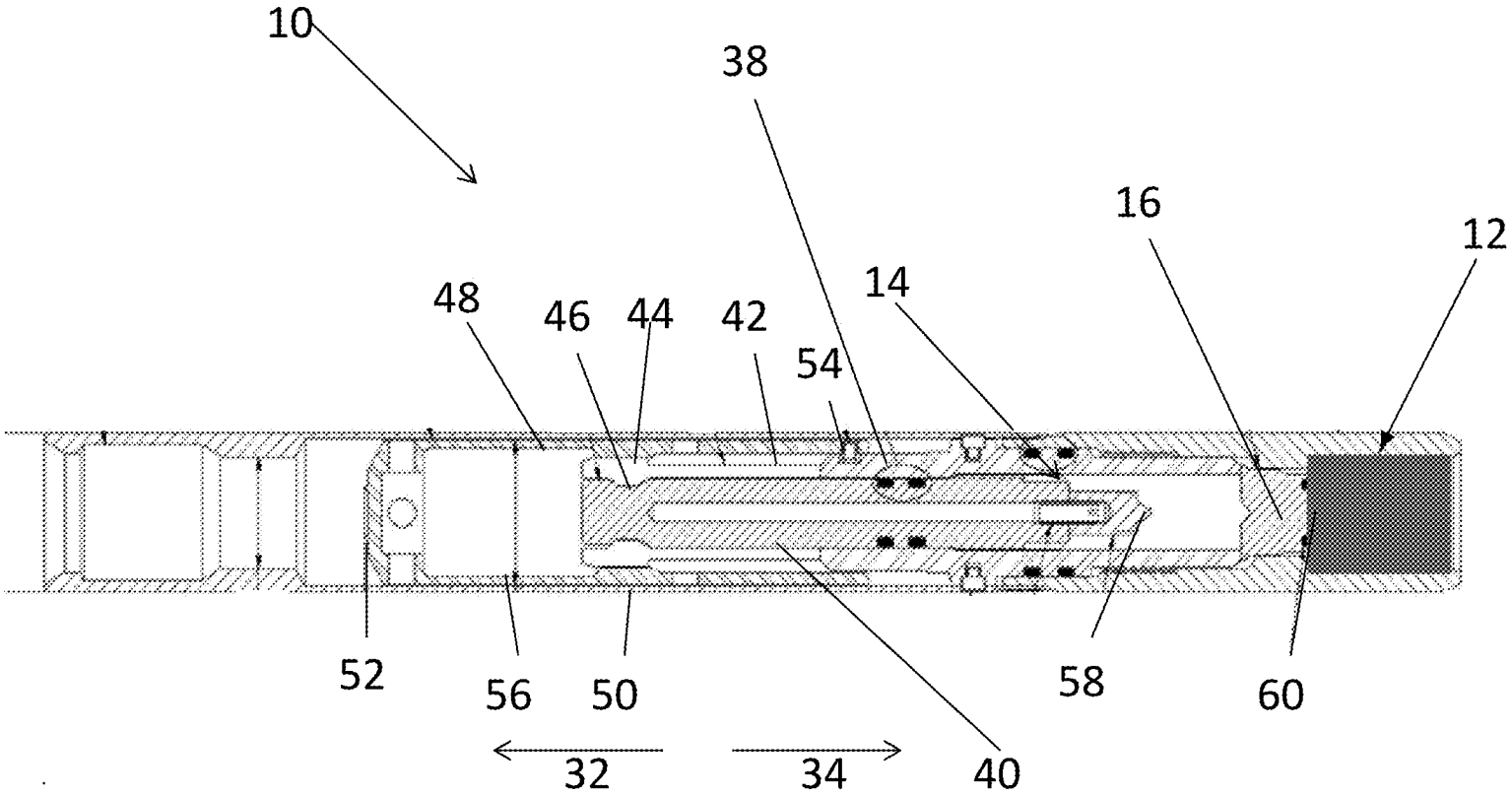
FIG. 3 is a sectional view of another embodiment of a system for degrading a downhole structure.

With reference to FIG. 3, one non-limiting embodiment of the impactor 14 is illustrated. The impactor 14 shown in FIG. 3 is a mechanical firing head 38 and includes a hammer 40 held in place by a collet 42 when collet fingers 44 of the collet 42 engage a profile 46 in the hammer 40. The collet 42 is supported by a sleeve 48. The collet fingers 44 are forced radially inward into the profile 46 by a first section 50 of the sleeve 48 which has a first inner diameter. When initiation of the degradation of the structure 12 is desired, the impactor 14 is delivered downhole (if not already in place downhole) and an object is dropped onto the uphole end 52 of sleeve 48 to break the shear screws 54 and to shift the sleeve 48 in the downhole direction 34 relative to the collet 42. As the sleeve 48 moves downhole, the collet fingers 44 are able to expand within a second section 56 of the sleeve 48 which has a second inner diameter that is larger than the first inner diameter. At this point, since the hammer 40 is no longer locked longitudinally by the collet 42, hydrostatic pressure can drive the hammer 40 in the downhole direction 34 to punch the hammer head 58 into the ignitor 16, thus setting off the firing.

The structure 12 is schematically illustrated in FIGS. 1-3 and not particularly limited. The structure 12 may include, but is not limited to, a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, ICD plugs, a flapper valve, a gaslift valve, a transmatic CEM plug, float shoes, darts, diverter balls, shifting/setting balls, ball seats, sleeves, teleperf disks, direct connect disks, drill-in liner disks, fluid loss control flappers, shear pins or screws, cementing plugs, teleperf plugs, drill in sand control beaded screen plugs, HP beaded frac screen plugs, hold down dogs and springs, a seal bore protector, a stimcoat screen protector, a liner port plug, a whipstock, a cylinder, or a liner plug.

Figure 4:
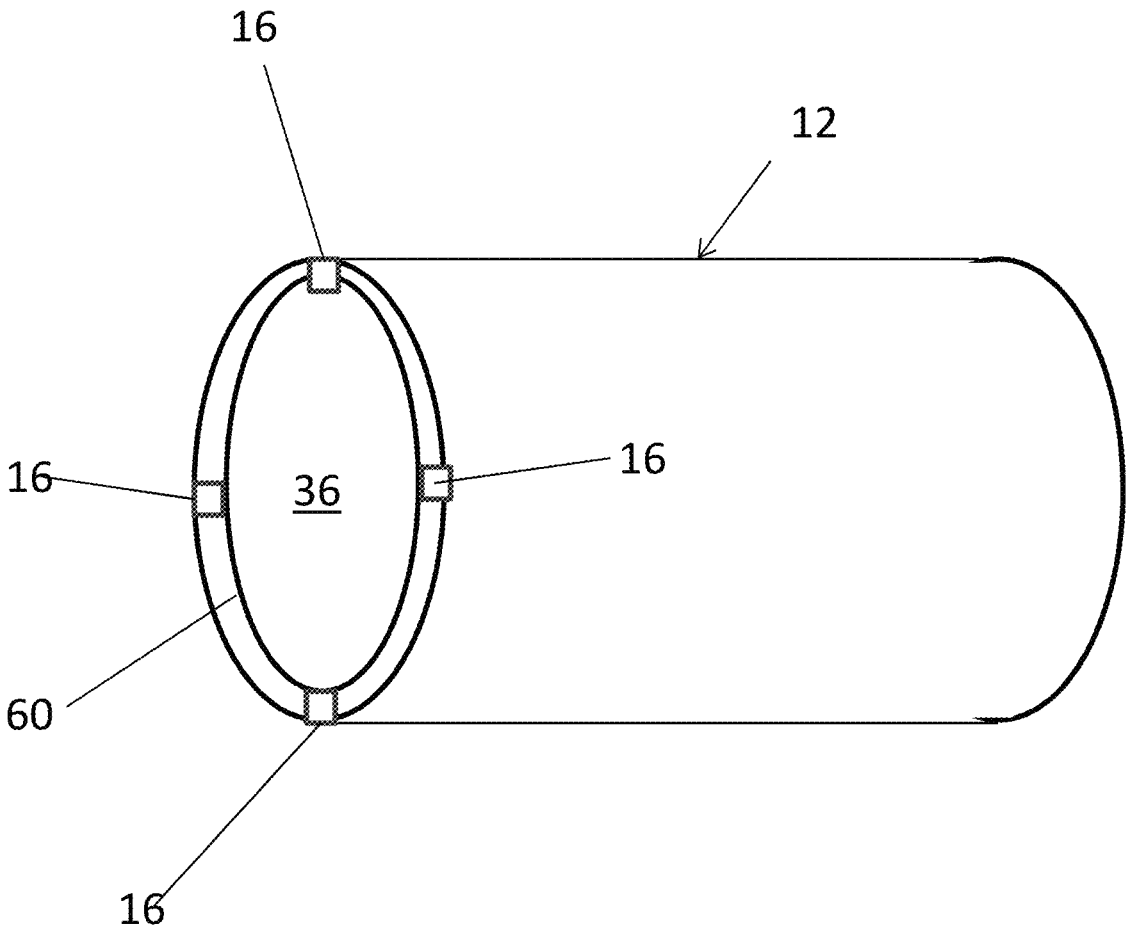
FIG. 4 is a perspective view of another embodiment of a downhole structure for use in the system; and, FIG. 5 is a schematic diagram of another embodiment of a downhole structure for use in the system.

While the structure 12 and the ignitor 16 are schematically depicted as blocking the flowbore 36 of the downhole tubular 24 in FIGS. 1-3, FIG. 4 depicts another embodiment of the structure 12 where fluid flow is allowed through the structure 12 and the downhole tubular 24 prior to degradation of the structure 12. The structure 12 of FIG. 4 may also prohibit flow therethrough when a ball is landed on a seat of the structure 12. In such an embodiment, the ignitor 16 is positioned on a portion of the structure 12, such as an uphole end 60. Also, while only one ignitor 16 is depicted in FIGS. 1-3, FIG. 4 depicts an embodiment where a plurality of ignitors 16 is positioned on the structure 12. Also, the ignitors 16 shown in FIG. 4 are disposed within the system 10 such that they also permit fluid flow through the flowbore 36 of the structure 12 and the downhole tubular 24.

Figure 5:
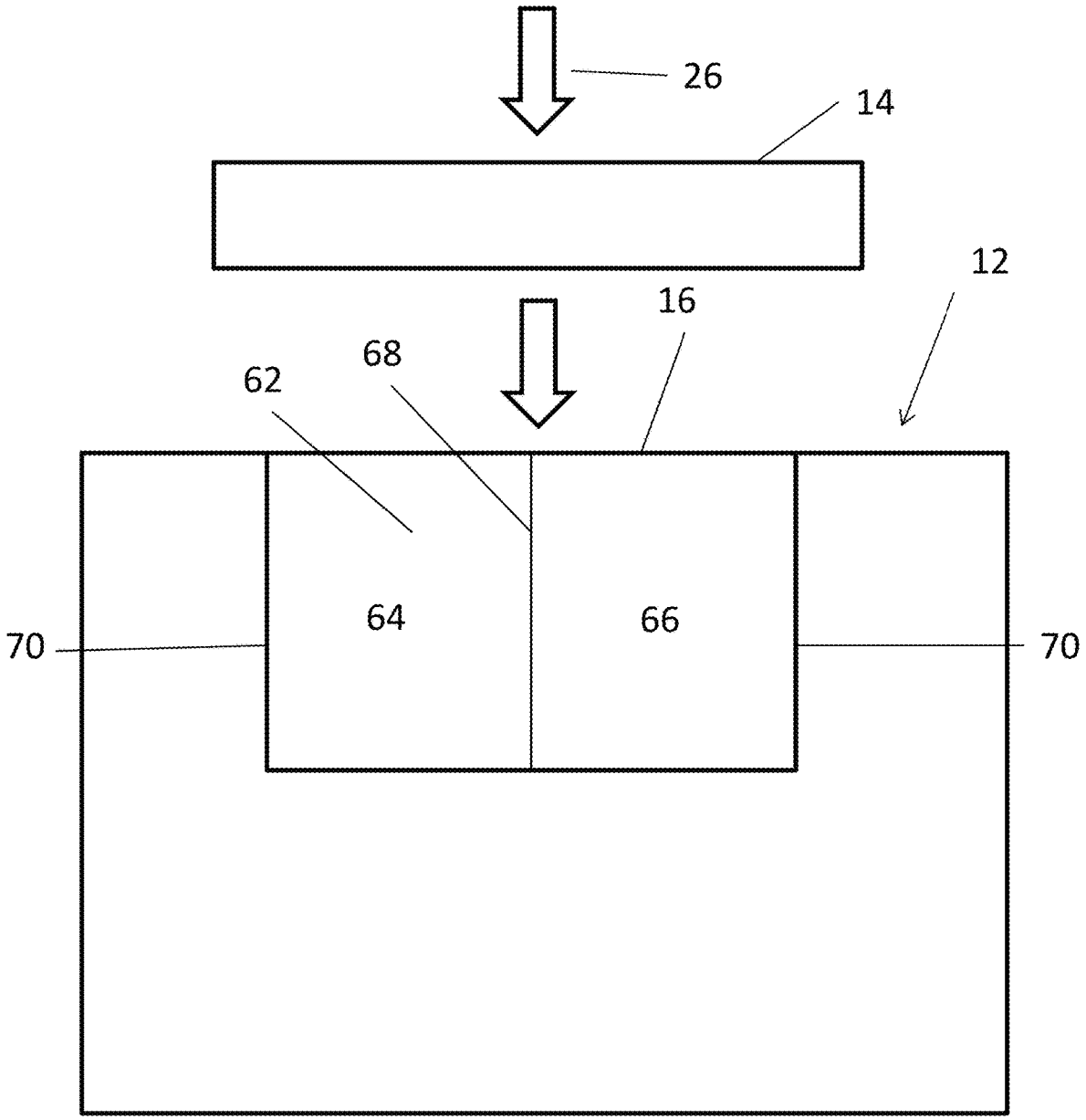

The ignitor 16 depicted in FIGS. 1-4 is provided at an end of the structure 12, and therefore the mechanical impactor 14 does not impact the structure 12 directly. In other embodiments, one or more of the ignitors 16 may be embedded or partially embedded within the structure 12, such that the structure 12 includes the ignitor 16. One embodiment of a structure 12 including an ignitor 16 is shown in FIG. 5. In such an embodiment, the structure 12 may be impacted directly. Due to the DOD material 18, wherever the ignitor 16 is located on the structure 12, and wherever the ignition begins in the structure 12, the degradation will continue throughout the entire structure 12. Thus, the ignitor 16 location relative to the structure 12 may be altered, as long as the mechanical impactor 14 is capable of impacting the ignitor 16, and the ignitor 16 is capable of transferring heat to the structure 12 that is at or above the threshold temperature.

As further depicted in FIG. 5, the ignitor 16 can include two or more chemicals 62 and the impact by the impactor 14 onto the ignitor 16 can cause the chemicals 62 to interact to create enough heat that would ignite the structure 12, and in particular the starting point or points 28 of the energetic material 22. In one non-limiting example, a first chemical 64 may be potassium permanganate (KMnO4), and a second chemical 66 may be one or more of glycerol, ethylene glycol, and propylene glycol. When the KMnO4 powder and the glycerol mix, the mixture will self-ignite. In another embodiment, the mechanical impactor 14 may be used to compress a chemical containing chamber. When a chamber with gas is compressed such as by a piston, the mechanical work done on the gas will lead to quick rise of temperature. Compression ignition can further include using a diesel mixture. Also, ignition can occur when pyrophoric gases are mixed with air: for example, nonmetal hydrides such as silane and metal carbonyls (dicobalt octacarbonyl, nickel carbonyl), when pyrophoric liquids are mixed with air, for example, alkyllithium like tert-Butyllithium can catch fire when exposed to air, and when pyrophoric solids are mixed with air: fine metal powder including iron, aluminium, magnesium, calcium, zirconium, titanium; fine powder mixtures of Pd and Al, Cu and Al, Ni and Al, Ti and boron, the two powder combination will release additional heat; white phosphorous; and metal hydride such as lithium aluminium hydride. The chemicals 62 are separated initially, such as by a frangible wall 68, and the mechanical impact will cause the chemicals 62 to interact with each other when the frangible wall 68 is broken upon mechanical impact. Alternatively, the containers 70 for the chemicals 62 may be arranged such that upon mechanical impact one container 70 is moved relative to another container 70 to allow fluidic communication therebetween or to expose one container 70 to air. As in previous embodiments, the ignitor 16 is disposed to transfer heat to the structure 12 (whether by direct or indirect conduction or by radiation) such that the heat created from the mixture of the two or more chemicals 62 will ignite the structure 12.

The structure 12 disclosed herein can be controllably removed such that significant disintegration only occurs after the structure 12 has completed its function(s). A method of controllably removing the structure 12 includes disposing the structure 12 in a downhole environment; performing a downhole operation that involves the structure 12; impacting an ignitor 16 to raise the temperature of the ignitor 16, transferring heat from the ignitor 16 to the structure 12, and degrading the structure 12.

The methods allow for a full control of the degradation and disintegration profile of the structure 12. The structure 12 can retain its physical properties until degradation is desired. The structure 12 and any associated assemblies can perform various downhole operations while the degradation of the structure 12 is minimized The downhole operation is not particularly limited and can be any operation that is performed during drilling, stimulation, completion, production, or remediation. Because the start of the degradation process can be controlled, the structure 12 can be designed to have an aggressive corrosion rate in order to accelerate the degradation process after ignition once the structure 12 is no longer needed. Once the structure 12 is no longer needed, the degradation of the article is initiated by impacting the ignitor 16 and transferring heat to the structure 12. Degradation of the structure 12 is accelerated by activating the energetic material 22 within the structure 12.

Before activation, the structure 12 may include both the network 30 of the energetic material 22 and the matrix material 20. After activation, heat is generated, and the structure 12 breaks into small pieces. In an embodiment, the small pieces can further corrode in a downhole fluid forming powder particles. The powder particles can flow back to the surface, thus conveniently removed from the borehole.

Set forth below are various embodiments of the disclosure.

Embodiment 1: A system for degrading a structure, the system including the structure formed of a degradable-on-demand material, an ignitor arranged to transfer heat to the structure, and a mechanical impactor movable with respect to the structure, wherein the ignitor increases in temperature upon impact of the mechanical impactor into the ignitor, and heat from the ignitor initiates degradation of the structure.

Embodiment 2: The system as in any prior embodiment, or combination of embodiments, wherein the mechanical impactor is a hammer Embodiment 3: The system as in any prior embodiment, or combination of embodiments, wherein the hammer is driven in a direction towards the ignitor by hydrostatic pressure.

Embodiment 4: The system as in any prior embodiment, or combination of embodiments, wherein the ignitor and the structure provide a flowbore.

Embodiment 5: The system as in any prior embodiment, or combination of embodiments, wherein the mechanical impactor is formed of the degradable-on-demand material and degrades upon impact with the ignitor.

Embodiment 6: The system as in any prior embodiment, or combination of embodiments, wherein the degradable-on-demand material includes a network of energetic material in a matrix material, and the ignitor transfers heat to at least one starting point of the network of energetic material to facilitate degradation of both the structure and the mechanical impactor.

Embodiment 7: The system as in any prior embodiment, or combination of embodiments, wherein the degradable-on-demand material includes an energetic material configured to generate energy upon activation to facilitate the degradation of the structure.

Embodiment 8: The system as in any prior embodiment, or combination of embodiments, wherein the degradable-on-demand material further includes a matrix material distributed within a network of the energetic material, the network releasing heat to the matrix material after impact of the mechanical impactor into the ignitor.

Embodiment 9: The system as in any prior embodiment, or combination of embodiments, wherein the energetic material is activated when the ignitor transfers heat at or above a threshold temperature at one or more starting points of the network of the energetic material.

Embodiment 10: The system as in any prior embodiment, or combination of embodiments, wherein the ignitor includes an explosive and/or flammable material.

Embodiment 11: The system as in any prior embodiment, or combination of embodiments, wherein the ignitor includes two or more chemicals separated from each other prior to impact by the mechanical impactor, and mixed together after impact by the mechanical impactor, and mixture of the two or more chemicals generates heat.

Embodiment 12: The system as in any prior embodiment, or combination of embodiments, wherein the energetic material comprises continuous fibers, wires, or foils, or a combination comprising at least one of the foregoing, which form a three dimensional network; and the matrix material is distributed throughout the three dimensional network.

Embodiment 13: The system as in any prior embodiment, or combination of embodiments, wherein the ignitor is in direct contact with the structure.

Embodiment 14: The system as in any prior embodiment, or combination of embodiments, wherein the ignitor is interposed between the mechanical impactor and the structure.

Embodiment 15: A method of degrading a structure, the method including moving a mechanical impactor with respect to the structure, impacting the impactor into an ignitor to increase a temperature of the ignitor, transferring heat from the ignitor to the structure to initiate degradation of a degradable-on-demand material of the structure, and degrading the degradable-on-demand material of the structure.

Embodiment 16: The method as in any prior embodiment, or combination of embodiments, wherein moving the mechanical impactor includes moving a hammer into the ignitor.

Embodiment 17: The method as in any prior embodiment, or combination of embodiments, further comprising utilizing heat from the ignitor to degrade a degradable-on-demand material of the mechanical impactor.

Embodiment 18: The method as in any prior embodiment, or combination of embodiments, wherein the ignitor includes two or more chemicals separated from each other prior to impact by the mechanical impactor, and mixed together after impact by the mechanical impactor.

Embodiment 19: The method as in any prior embodiment, or combination of embodiments, wherein the ignitor includes an explosive and/or flammable material.

Embodiment 20: The method as in any prior embodiment, or combination of embodiments, wherein the degradable-on-demand material includes an energetic material configured to generate energy upon activation to facilitate the degradation of the structure, the energetic material including a network, and the degradable-on-demand material further including a matrix material, the network releasing heat to the matrix material after impact of the mechanical impactor into the ignitor.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity). Further, it should further be noted that the terms "first," "second," and the like herein do not denote any order, quantity, or importance, but rather are used to distinguish one element from another.

The teachings of the present disclosure apply to downhole assemblies and downhole tools that may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A system for degrading a structure formed of a degradable-on-demand (DOD) material arranged in a flowbore of a downhole tubular configured for use in a wellbore, the system comprising:

an ignitor protruding from an outer surface of the structure, the ignitor being configured to transfer heat to the structure; and a mechanical impactor movable with respect to the structure that is configured to impact the ignitor, wherein the mechanical impactor, upon impacting the ignitor, triggersthe ignitor to ignite the DOD material to thereby release energy that initiates degradation of the structure within the downhole tubular.

2. The system of claim 1, wherein the mechanical impactor is a hammer.

3. The system of claim 2, wherein the hammer is driven in a direction towards the ignitor by hydrostatic pressure.

4. The system of claim 1, wherein the ignitor and the structure provide a flowbore.

5. The system of claim 1, wherein the mechanical impactor is formed of the degradable-on-demand material and degrades upon impact with the ignitor.

6. The system of claim 5, wherein the degradable-on-demand material includes a network of energetic material in a matrix material, and the ignitor transfers heat to at least one starting point of the network of energetic material to facilitate degradation of both the structure and the mechanical impactor.

7. The system of claim 1, wherein the degradable-on-demand material includes an energetic material configured to generate energy upon activation to facilitate the degradation of the structure.

8. The system of claim 7, wherein the degradable-on-demand material further includes a matrix material distributed within a network of the energetic material, the network releasing heat to the matrix material after impact of the mechanical impactor into the ignitor.

9. The system of claim 8, wherein the energetic material is activated when the ignitor transfers heat at or above a threshold temperature at one or more starting points of the network of the energetic material.

10. The system of claim 1, wherein the ignitor includes an explosive and/or flammable material.

11. The system of claim 1, wherein the ignitor includes two or more chemicals separated from each other prior to impact by the mechanical impactor, and mixed together after impact by the mechanical impactor, and mixture of the two or more chemicals generates heat.

12. The system of claim 6, wherein the energetic material comprises at least one of continuous fibers, wires, or foils, which form a three dimensional network; and the matrix material is distributed throughout the three dimensional network.

13. The system of claim 1, wherein the ignitor is in direct contact with the structure.

14. The system of claim 1, wherein the ignitor is interposed between the mechanical impactor and the structure.

15. A method of degrading a structure formed of a degradable-on-demand (DOD) material arranged in a flowbore of a downhole tubular configured for use in a wellbore, the method comprising:

moving a mechanical impactor with respect to the structure;

impacting the mechanical impactor into an ignitor protruding from an outer surface of the structure;

igniting the DOD material with the igniter; and degrading the structure in the flowbore of the downhole tubular with energy released from the DOD material.

16. The method of claim 15, wherein moving the mechanical impactor includes moving a hammer into the ignitor.

17. The method of claim 15, further comprising utilizing heat from the ignitor to degrade a degradable-on-demand material of the mechanical impactor.

18. The method of claim 15, wherein the ignitor includes two or more chemicals separated from each other prior to impact by the mechanical impactor, and mixed together after impact by the mechanical impactor.

19. The method of claim 15, wherein the ignitor includes an explosive and/or flammable material.

20. The method of claim 15, wherein the degradable-on-demand material includes an energetic material configured to generate energy upon activation to facilitate the degradation of the structure, the energetic material including a network, and the degradable-on-demand material further including a matrix material, the network releasing heat to the matrix material after impact of the mechanical impactor into the ignitor.

* * * * *